US010024313B2

(12) United States Patent
Ambrosina et al.

(10) Patent No.: US 10,024,313 B2
(45) Date of Patent: Jul. 17, 2018

(54) PUMP CHAMBER INCLUDING INTERNAL SURFACE MODIFICATIONS

(71) Applicant: Invenix, Inc., Amesbury, MA (US)

(72) Inventors: Jesse E. Ambrosina, Topsfield, MA (US); Benajamin G. Powers, Portsmouth, NH (US); Alexander J. Segit, Eliot, ME (US); David I. Nazzaro, Groveland, MA (US)

(73) Assignee: Ivenix, Inc., Amesbury, MA (US)

( * ) Notice: Subject to any disclaimer, the term of this patent is extended or adjusted under 35 U.S.C. 154(b) by 778 days.

(21) Appl. No.: 14/540,074

(22) Filed: Nov. 13, 2014

(65) Prior Publication Data

US 2015/0139821 A1 May 21, 2015

Related U.S. Application Data

(60) Provisional application No. 61/904,814, filed on Nov. 15, 2013.

(51) Int. Cl.
*F04B 43/06* (2006.01)
*F04B 53/16* (2006.01)

(52) U.S. Cl.
CPC ..... *F04B 43/06* (2013.01); *F04B 53/16* (2013.01); *Y10T 29/49236* (2015.01)

(58) Field of Classification Search
CPC ..... F04B 43/00; F04B 43/02; F04B 43/06; F04B 43/073; F04B 45/00; F04B 45/04;
(Continued)

(56) References Cited

U.S. PATENT DOCUMENTS 3,781,141 A 12/1973 Schall
4,594,058 A 6/1986 Fischell
(Continued)

FOREIGN PATENT DOCUMENTS

DE 102 06 667 C1 12/2003
FR 2 255 586 A1 7/1975
(Continued)

OTHER PUBLICATIONS

Supplementary European Search Report, EP 14 86 3023, dated Sep. 28, 2016, pp. 9.
(Continued)

*Primary Examiner* — Dominick L Plakkoottam
*Assistant Examiner* — Chirag Jariwala
(74) *Attorney, Agent, or Firm* — Chapin IP Law, LLC

(57) ABSTRACT

A combination of a chamber wall and the flexible membrane defines a pump chamber in a diaphragm pump. The pump chamber includes one or more internal surfaces that are modified to include a pattern of a pattern of channel surface regions. The channel surface regions provide unobstructed pathways to a respective opening disposed on an internal surface of the chamber wall. For example, as discussed herein, presence of the channel surface regions ensures that the facing of the flexible membrane does not needlessly stick (as a result of residual suction) to an inside surface of the chamber wall during a portion of the pump stroke in which negative pressure is applied to a backing of the flexible membrane. In other words, the channel surface regions distribute relief pressure along the inside surface of the pump chamber wall.

21 Claims, 18 Drawing Sheets

(58) Field of Classification Search
CPC .... F04B 45/053; F04B 45/0536; F04B 53/16; Y10T 29/49236
See application file for complete search history.

(56) References Cited

U.S. PATENT DOCUMENTS

| | | | | |
|---|---|---|---|---|
| 4,848,722 | A | 7/1989 | Webster | |
| 5,593,290 | A * | 1/1997 | Greisch | F04B 19/006 417/478 |
| 5,669,764 | A | 9/1997 | Behringer et al. | |
| 8,454,324 | B2 * | 6/2013 | Grapes | F04B 43/06 417/395 |
| 2006/0251533 | A1 | 9/2006 | Nighy et al. | |
| 2007/0140873 | A1 | 6/2007 | Grapes | |
| 2010/0086419 | A1 * | 4/2010 | Rebsamen | A61M 1/06 417/472 |
| 2010/0228196 | A1 * | 9/2010 | Wyss | A61J 1/1475 604/151 |
| 2011/0054397 | A1 | 3/2011 | Menot et al. | |
| 2012/0022451 | A1 * | 1/2012 | Silver | F04B 43/06 604/151 |

FOREIGN PATENT DOCUMENTS

| | | | | |
|---|---|---|---|---|
| FR | 2255586 | A1 * | 7/1975 | F04B 43/0054 |
| WO | WO 2009 094183 | A1 | 7/2009 | |

OTHER PUBLICATIONS

International Search Report, PCT/US2014/065337, 3 pages, dated Mar. 17, 2015.

* cited by examiner

PUMP CHAMBER INCLUDING INTERNAL SURFACE MODIFICATIONS

RELATED APPLICATIONS

This application claims the benefit of U.S. Provisional Patent Application Ser. No. 61/904,814 entitled "Pneumatically Operated Diaphragm Pump with Highly Repeatable Stroke Volume," filed on Nov. 15, 2013, the entire teachings of which are incorporated herein by this reference.

BACKGROUND

Conventional techniques of delivering fluid to a recipient can include drawing a fluid from a fluid source into a chamber of a diaphragm pump. After the chamber is filled, a respective fluid delivery system applies a pressure to the chamber causing the fluid in the chamber to be delivered to a corresponding patient. The rate at which the fluid is delivered to the recipient may vary depending upon a number of factors such as the magnitude of pressure applied to the chamber, fluid flow resistance, etc. Eventually, after applying pressure to the chamber for a sufficient amount of time, all of the fluid in the chamber is delivered to the recipient.

In most applications, the amount of fluid drawn into the chamber of the diaphragm pump is substantially less than the overall amount of fluid to be delivered to the patient. To deliver the appropriate amount of fluid to the patient over time, the fluid delivery system repeats the cycle of drawing fluid from the fluid source into the chamber, and then applying pressure to the chamber to deliver the fluid to the recipient.

According to conventional techniques, based on the amount of elapsed time between time successive operations of drawing fluid into and expelling the fluid out of the chamber in the diaphragm pump, the fluid delivery system is able to determine the rate at which fluid is delivered to a corresponding patient.

BRIEF DESCRIPTION OF EMBODIMENTS

Embodiments herein relate to hydraulically or pneumatically actuated diaphragm pumps. The improvements described herein are applicable to any diaphragm pump or fluid delivery system using a first fluid to control movement of a membrane in the diaphragm pump to deliver a second fluid to a target recipient.

There are two factors required for flow rate accuracy of delivering fluid from a diaphragm pump. The first factor is fluctuation in flow rate. Fluctuations in flow rate are related to how much time is needed to fully empty and fill the pump chamber during each stroke. The second factor is volumetric accuracy of each pump stroke over time.

In general, even if there is a fluctuation in flow rate, if the period of averaging is long enough, the fluctuations in stroke volume tend to average out and the volumetric accuracy of overall flow is maintained. When flow rate accuracy is needed in short time frames, without fluctuation, the stroke-to-stroke volume delivered must be very consistent and the fill/empty cycle timing very precise.

Thus, in summary, the two measures of pump performance are the repeatability of volume delivered per stroke and the repeatability of the time to empty and fill the chamber. These critical performance characteristics are primarily influenced by how the pump membrane interacts with the pump chamber walls during the fill and empty cycles. If air or liquid on either the drive side or the pump side is trapped or restricted, either the repeatability of the volume delivered or the time to empty/fill can be negatively affected.

In contrast to conventional techniques, embodiments herein include modifying one or more internal surfaces of conventional diaphragm pumps to provide more accurate delivery of fluid to a target resource (i.e., any type of entity such as a patient, machine, container, etc.).

More specifically, one embodiment herein includes an apparatus comprising a flexible membrane and a chamber wall. A combination of the chamber wall and the flexible membrane defines a pump chamber. In one embodiment, an internal surface of the chamber wall includes channel surface regions and non-channel surface regions.

During operation such as delivery of fluid from the pump chamber to a corresponding recipient, a pump control resource applies a respective pressure to the flexible membrane to expel fluid in the pump chamber through a respective opening to an output port. If the channel surface regions and non-channel surface regions are disposed on a pump chamber wall (which may be rigid), at or around the end of a respective pump stroke, application of positive pressure eventually causes the facing of the flexible membrane to come in contact with non-channel surface regions on the chamber wall. To fill the chamber again, the controller applies a negative pressure to the flexible membrane. The negative pressure causes the facing of the flexible membrane to pull away from the non-channel surface regions of the chamber wall, causing the fluid chamber to fill with fluid again. The presence of the channel surface regions extending from the opening along the chamber wall ensures that the facing of the flexible membrane does not needlessly stick (as a result of residual suction) to the inside surface of the chamber wall. In other words, the channel surface regions disposed on a rigid internal surface of the chamber of the diaphragm pump as described herein help to distribute relief pressure from the opening along the inside surface of the pump chamber wall.

In contrast to conventional techniques, the inclusion of channel surfaces amongst non-channel surfaces in the pump chamber provides a more accurate delivery of volume for each stroke of filling and subsequently emptying the pump chamber.

As further discussed below, note that any suitable one or more surfaces in a pump chamber can be modified according to embodiments herein. For example, as an alternative to modifying a respective internal surface of a chamber wall (i.e., a surface in the pump chamber opposite a facing of the flexible membrane), the facing of the flexible membrane can be modified to include the channel surface regions and non-channel surface regions.

In accordance with further embodiments, if desired, both the internal surface of the chamber wall and the facing of the flexible membrane can be modified as described herein to include channel surface regions and non-channel surface regions.

As indicated above, presence of the channel surface regions helps to alleviate residual suction of the facing of the flexible membrane against the internal surface of the chamber wall during a fluid delivery stroke.

Accordingly, embodiments herein include an apparatus (such as a diaphragm pump) including a first element (such as a flexible membrane) and a second element (such as a chamber wall). The combination of the first element and the second element define a respective pump chamber associated with the diaphragm pump. The respective pump chamber includes an internal surface. The internal surface includes a pattern of channel surface regions and non-channel surface regions.

In one embodiment, as mentioned, the internal surface of the pump chamber is a facing of the flexible membrane. During a fluid delivery portion of a pump stroke, application of positive pressure to a backside of the flexible membrane causes the non-channel surface regions on the facing of the flexible membrane to contact a corresponding surface on the chamber wall. The channel surface regions on the flexible membrane provide an unobstructed pathway to a respective opening disposed on the internal surface of the chamber wall.

Thus, embodiments herein include a highly accurate diaphragm pump chamber assembled from two pump housings (a first chamber wall element and a second chamber while element) with a flat sheet membrane clamped between them. Each housing contains one or more entrance and exit ports. In one embodiment, the inner surfaces of the chamber walls include a series of channels that extend radially from the one or more entrance and exit ports to locations on the outer diameter of the pump chamber. Additionally, if desired, the channels can be configured as a pattern of concentric channels connected to the set of radial channels. The textured surfaces at one of more locations in the pump chamber are optionally textured to help prevent sticking of the elastomeric membrane to the surfaces of the pump chamber walls. The textured surfaces also prevent trapping of fluid between the flexible membrane and a corresponding inner surface of the chamber wall.

These and other more specific embodiments are disclosed in more detail below.

As discussed herein, techniques herein are well suited for reducing adhesion of a respective flexible membrane to one or more internal surfaces of a diaphragm pump, providing more accurate delivery of fluid to a recipient during each respective pump stroke. However, it should be noted that embodiments herein are not limited to use in such applications and that the techniques discussed herein are well suited for other applications as well.

Additionally, note that although each of the different features, techniques, configurations, etc., herein may be discussed in different places of this disclosure, it is intended, where suitable, that each of the concepts can optionally be executed independently of each other or in combination with each other. Accordingly, the one or more present inventions as described herein can be embodied and viewed in many different ways.

Also, note that this preliminary discussion of embodiments herein purposefully does not specify every embodiment and/or incrementally novel aspect of the present disclosure or claimed invention(s). Instead, this brief description only presents general embodiments and corresponding points of novelty over conventional techniques. For additional details and/or possible perspectives (permutations) of the invention(s), the reader is directed to the Detailed Description section and corresponding figures of the present disclosure as further discussed below.

Figure 1:
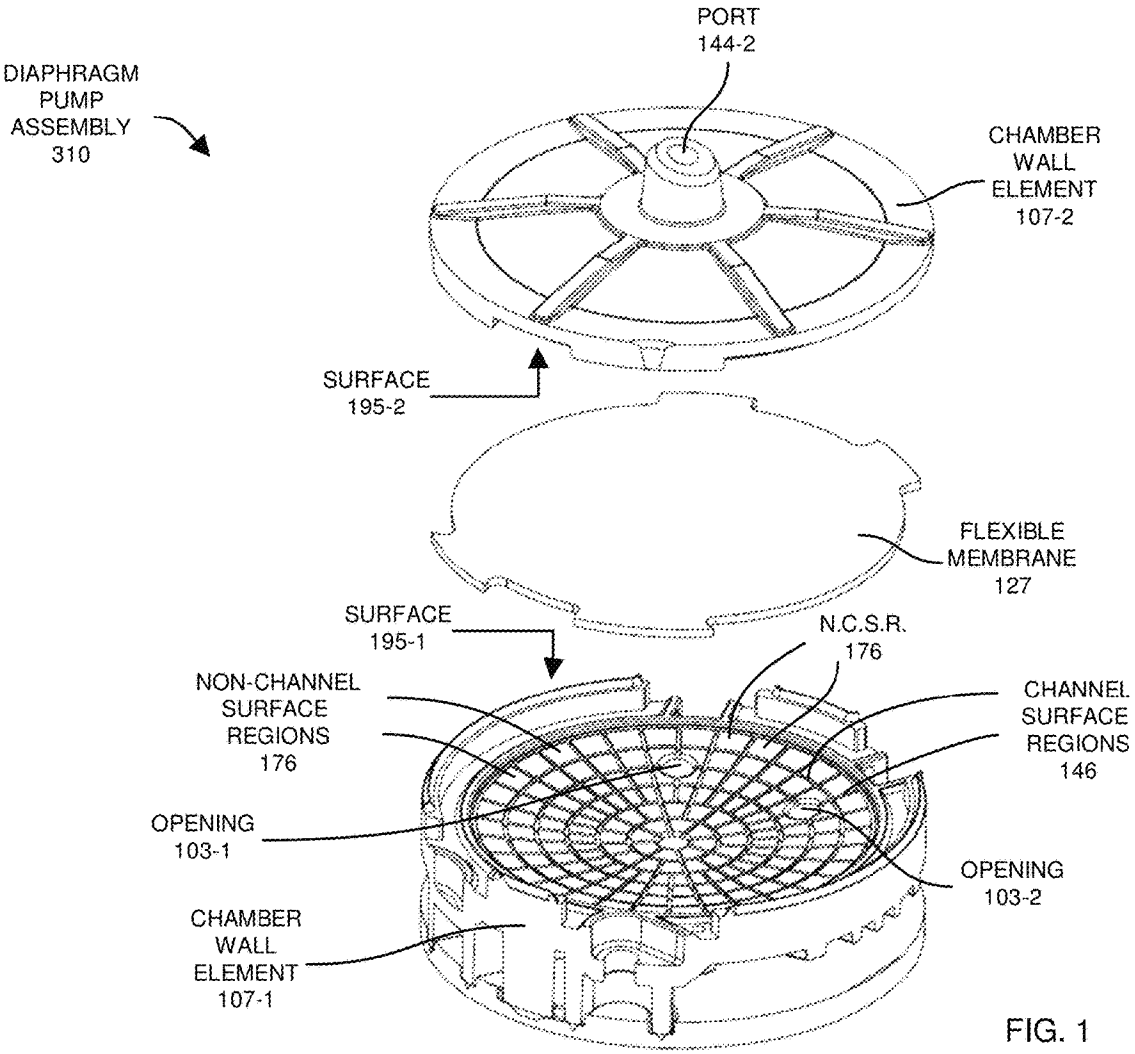
FIG. 1 is an example diagram illustrating an exploded perspective view of a diaphragm pump according to embodiments herein.

The foregoing and other objects, features, and advantages of the invention will be apparent from the following more particular description of preferred embodiments herein, as illustrated in the accompanying drawings in which like reference characters refer to the same parts throughout the different views. The drawings are not necessarily to scale, with emphasis instead being placed upon illustrating the embodiments, principles, concepts, etc.

DETAILED DESCRIPTION AND FURTHER SUMMARY OF EMBODIMENTS

In one embodiment, a combination of a chamber wall and the flexible membrane defines a pump chamber in a diaphragm pump. The pump chamber includes one or more internal surfaces (such as a facing of the flexible membrane, an internal surface of the chamber wall, etc.) that are modified to include a pattern of channel surface regions. The channel surface regions provide unobstructed pathways along the one or more internal surfaces to deliver a more accurate amount of fluid during a pump stroke.

Now, more specifically, FIG. 1 is an example diagram illustrating an exploded perspective view of a diaphragm pump according to embodiments herein.

As shown, the exploded diaphragm pump assembly 310 includes chamber wall element 107-1, flexible membrane 127, and chamber wall element 107-2. When assembled (FIG. 3), as further discussed below, the flexible membrane 127 is sandwiched between chamber wall element 107-1 and chamber wall element 107-2.

Chamber wall elements 170 can be made from any suitable material such as metal, plastic, etc.

In this non-limiting example embodiment, the port 144-2 extends through the chamber wall element 107-2 to a corresponding opening through surface 195-2 on the other side of chamber wall element 107-2.

Flexible membrane 127 can be made from any suitable type of material such as silicon, rubber, plastic, etc. In one non-limiting example embodiment, the flexible membrane 127 is die-cut from a silicone sheet.

As further shown in this non-limiting example embodiment, the facing on the surface 195-1 of chamber wall element 107-1 includes one or more openings such as opening 103-1, 103-2, etc., disposed at any of one or more locations on a respective surface 195-1. Similarly, the surface 195-2 of chamber wall element 107-2 can include any number of openings as well. Each opening is coupled to a respective port extending through the respective chamber wall element 107-2 to an appropriate inlet or outlet.

Additionally, as shown in this non-limiting example embodiment, the surface 195-1 of chamber wall element 107-1 includes channel surface regions 146 and non-channel surface regions 176.

In one non-limiting example, each of the channels in the channel surface regions 146 are 0.010 inches wide and 0.010 inches deep. However, these measurements can vary depending upon the embodiment.

As more particularly discussed herein, the channel surface regions 146 provide unobstructed fluid pathways, channel ways, fluid guides, etc., to the respective one or more openings 103-1, 103-2, etc., disposed on the surface 195-1 of the chamber wall element 107-1.

More specifically, application of positive pressure to flexible membrane 127 causes the respective surface of the flexible membrane 127 in an assembled diaphragm pump assembly 310 to come in contact with the surface 195-1; the channel surface regions 146 help to alleviate or reduce trapping of any fluid between flexible membrane 127 and the inside surface 195-1 of the chamber wall element 107-1 during a respective pump stroke. In other words, at the end of the respective stroke, fluid freely travels along the channel surface regions 146 to corresponding openings 103.

Additionally, presence of the channel surface regions 146 amongst non-channel surface regions 176 on the surface 195-1 helps to ensure that a respective facing of the flexible membrane 127 does not needlessly stick (as a result of residual suction) to the surface 195-1 of the chamber wall element 107-1 during a portion of a pump cycle in which negative pressure is applied to the flexible membrane 127 to pull the flexible membrane 127 off of and away from the surface 195-1.

Note that the surface 195-2 of the chamber wall element 107-2 can be configured to include channel surface regions and non-channel surface regions as well.

Use of channel regions to create channels is shown by way of non-limiting example. Any suitable type of relief pattern disposed on the surface 195-1 or on a respective surface of flexible membrane 127 can be used to create pathways, channels, conduits, etc., to respective openings in a respective surface of a chamber wall element, alleviating trapping of fluid and sticking of the flexible membrane 127 to a corresponding surface of the chamber wall element.

Figure 2:
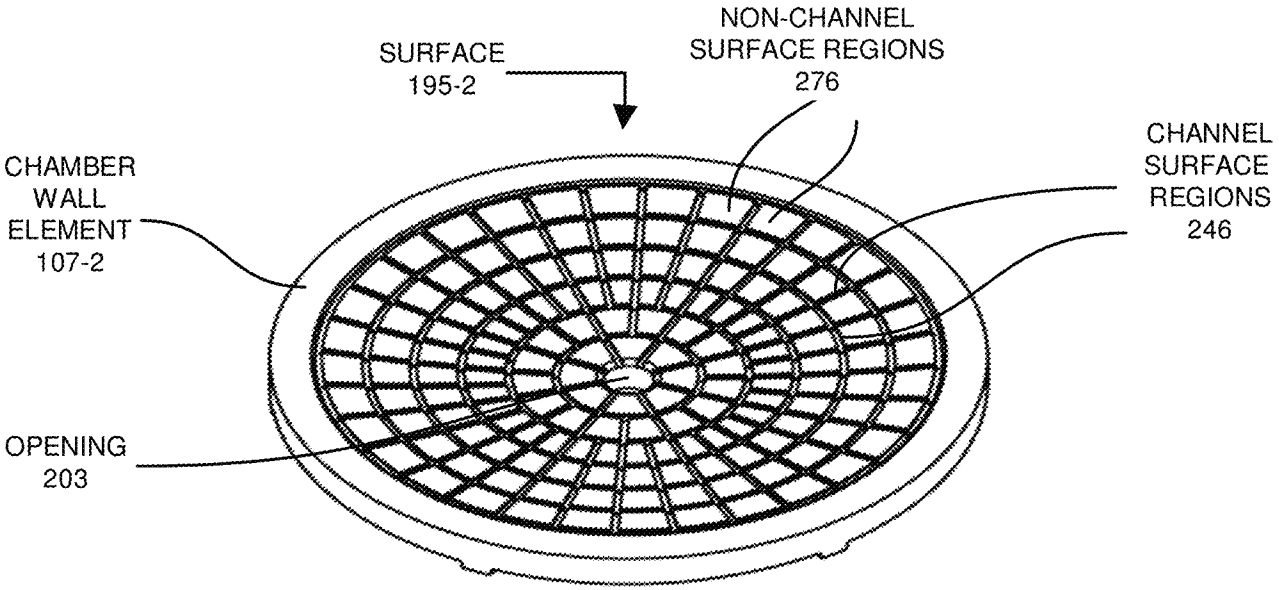
FIG. 2 is an example diagram illustrating a perspective view of a chamber wall element of a diaphragm pump according to embodiments herein.

FIG. 2 is an example diagram illustrating a perspective view of a chamber wall element of a diaphragm pump according to embodiments herein.

As shown, surface 195-2 of the chamber wall element 107-2 includes opening 203. In one embodiment, the opening 203 is communicatively coupled to port 144-2 (FIG. 1) enabling a respective flow of fluid. Similar to embodiments as previously discussed, surface 195-2 further includes a pattern of channel surface regions 246 and non-channel surface regions 276.

In this non-limiting example embodiment, the pattern of channel surface regions 246 includes grooves extending radially outward from opening 203 and concentric patterns of grooves intersecting with the radial grooves. As previously discussed, the channel surface regions 246 provide fluid pathways, channels, conduits, etc., enabling a flow of fluid to and from opening 203 when a facing of the flexible membrane 127 is in contact with the non-channel surface regions 276.

Figure 3:
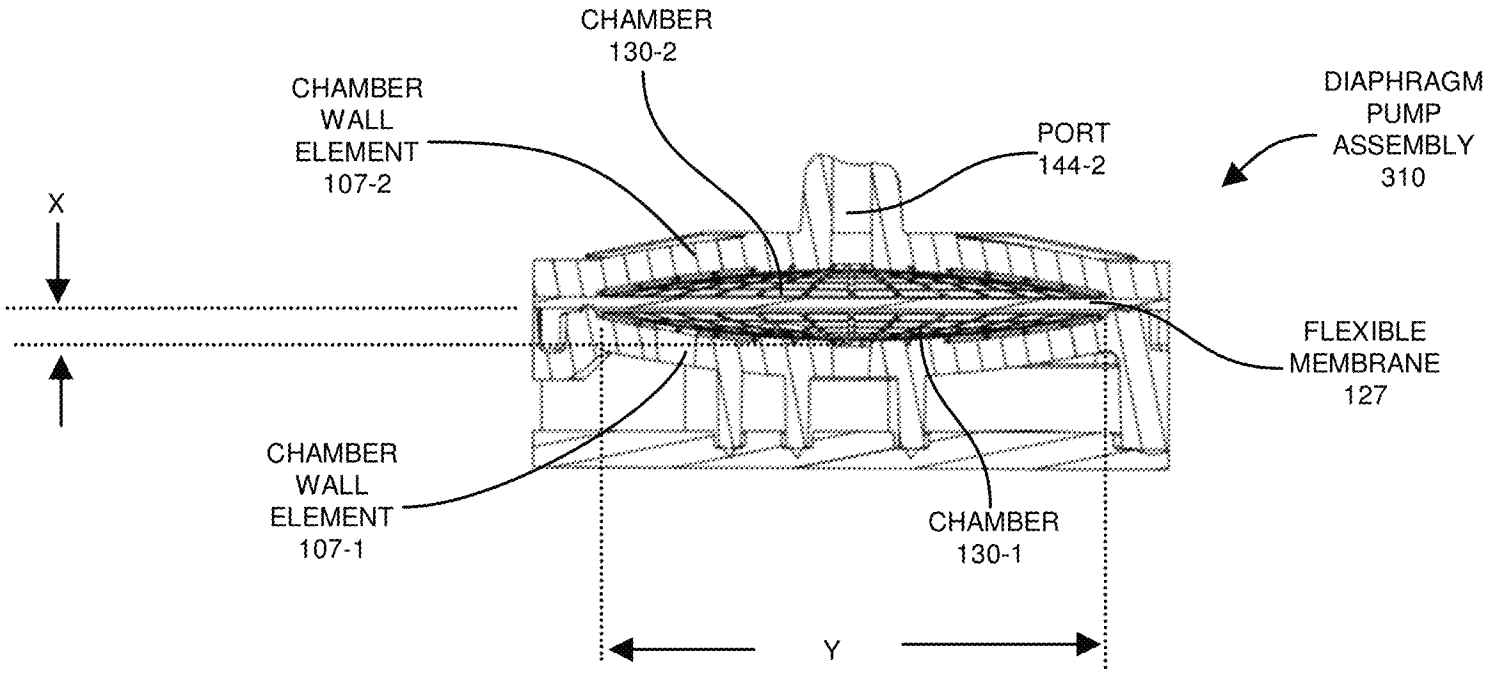
FIG. 3 is an example diagram illustrating a cutaway side view of an assembled diaphragm pump according to embodiments herein.

FIG. 3 is an example diagram illustrating a cutaway side view of an assembled diaphragm pump according to embodiments herein.

As shown in this example embodiment, the flexible membrane 127 is disposed between chamber wall element 170-1 and chamber wall element 107-2 of diaphragm pump assembly 310. Diaphragm pump assembly 310 includes a first chamber 130-1 disposed between surface 195-1 of chamber wall element 107-1 and a corresponding first surface of flexible membrane 127. Diaphragm pump assembly 310 includes a second chamber 130-2 disposed between surface 195-2 of chamber wall element 107-2 and a corresponding second surface of the flexible membrane 127.

In one embodiment, each of the surfaces 195 on a respective chamber wall element 107 is substantially concave. The non-channel surface regions 176 (276) are substantially planar in comparison to the channel surface regions 146 (246).

Positive and negative pressure applied to port 144-2 causes the flexible membrane 127 to produce the pumping action as previously discussed. That is, when a negative pressure is applied to port 144-2, fluid in chamber 130-2 is drawn out through port 144-2. In such an instance, the flexible membrane 127 is pulled into contact with surface 195-2. During application of negative pressure, the volume of chamber 130-2 decreases while the volume of chamber 130-1 increases.

Conversely, when a positive pressure is applied to the port 144-2, chamber 130-2 fills with fluid passing through port 144-2. In such an instance, the flexible membrane 127 is pushed away from surface 195-2 towards surface 195-1. During application of positive pressure, the volume of chamber 130-1 decreases while the volume of chamber 130-2 increases.

As previously discussed, presence of channels on the respective surfaces 195 of each of the chamber wall elements 107 prevents sticking of the flexible membrane to the respective surface and trapping of fluid between the flexible membrane and the respective surface.

In one non-limiting example embodiment, the value of X is 0.050 inches; the value of Y is 0.90 inches. Opening 103-1 has a diameter of 0.071 inches. However, note that settings for each of these dimensions can vary depending upon the embodiment.

Figure 4:
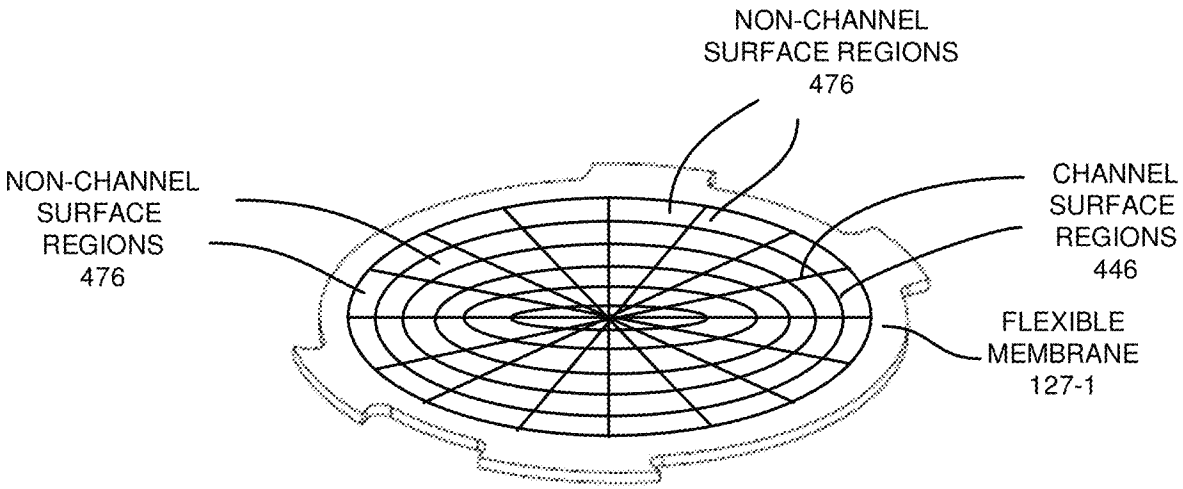
FIG. 4 is an example diagram illustrating a flexible membrane of a diaphragm pump according to embodiments herein.

FIG. 4 is an example diagram illustrating a flexible membrane of a diaphragm pump according to embodiments herein.

Note that as an alternative to modifying respective one or more surfaces 195 of a chamber wall elements 107 (i.e., a surface in the pump chamber opposite a facing of the flexible membrane 127 as previously discussed), one or more facings of the flexible membrane 127 (in FIG. 1) can be modified to include channel surface regions 446 and non-channel surface regions 476 as shown on flexible membrane 127-1 (in FIG. 4) to provide fluid pathways, channels, etc, to corresponding openings on surfaces 195. In such an instance, if desired, the corresponding opposing surfaces 195 on the chamber wall elements 107-1 and 107-2 can be smooth surfaces instead of channel surfaces.

In a similar manner as previously indicated, presence of the channel surface regions 446 on a respective facing of the flexible membrane 127-1 helps to alleviate residual suction or sticking of the respective facing of the flexible membrane 127-1 against the internal surfaces 195 (either smooth or un-smooth) of the chamber wall elements 107 during a fluid delivery stroke in which the respective flexible membrane 127-1 comes in contact with such surfaces 195.

Figure 5:
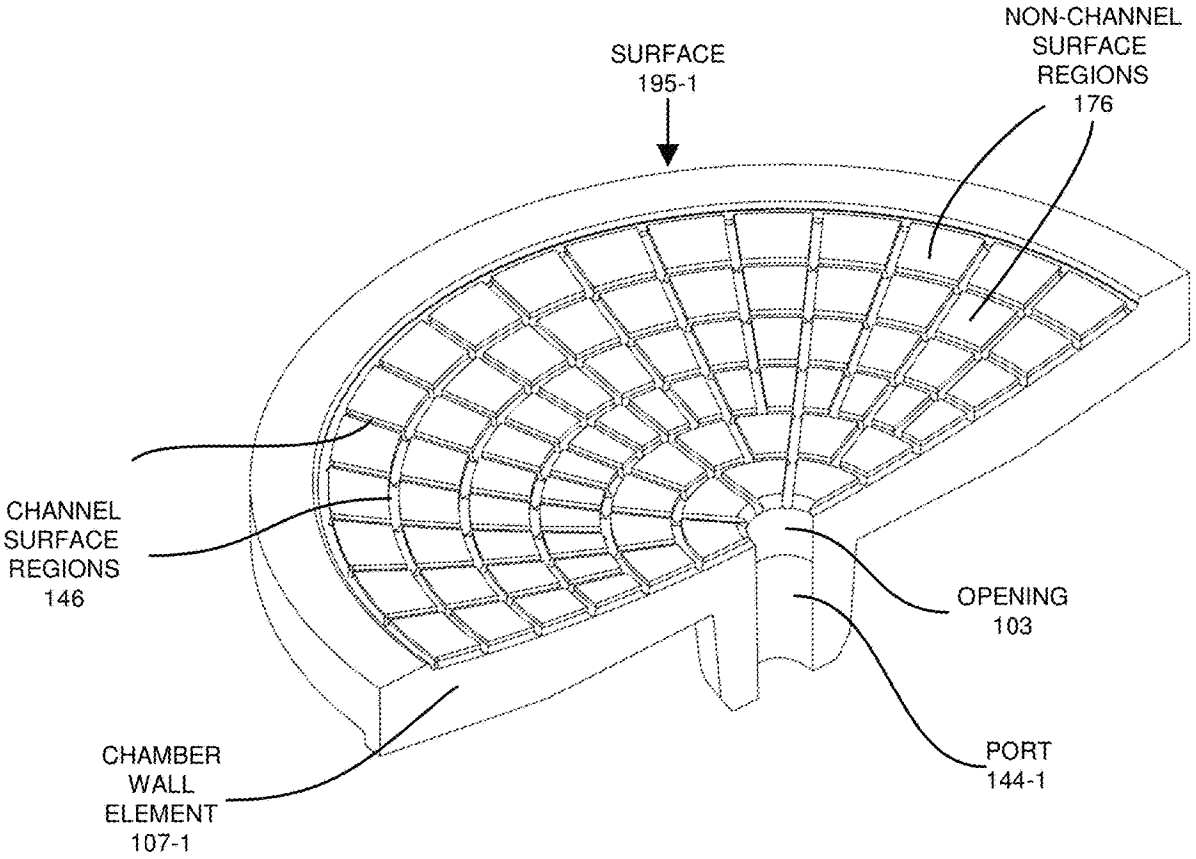
FIG. 5 is an example diagram illustrating a cutaway perspective view of a chamber wall surface of a diaphragm pump according to embodiments herein.

FIG. 5 is an example diagram illustrating a cutaway perspective view of a chamber wall surface of a diaphragm pump according to embodiments herein.

As shown, the channel surface regions 146 disposed on surface 195-1 of the chamber wall element 107-1 provide an unobstructed fluid pathway to opening 103 and port 144-1. As previously discussed, presence of the non-channel surface regions 176 prevent the corresponding flexible membrane 127 from occupying the channel surface regions 146 when the respective facing of the flexible membrane 127 is pressed against surface 195-1. Thus, even when the respective facing of the flexible membrane 127 is pressed against the non-channel surface regions 176 on surfaces 195-1, fluid disposed in the channel surface regions 146 is able to flow to opening 103 and port 144-1.

Figure 6:
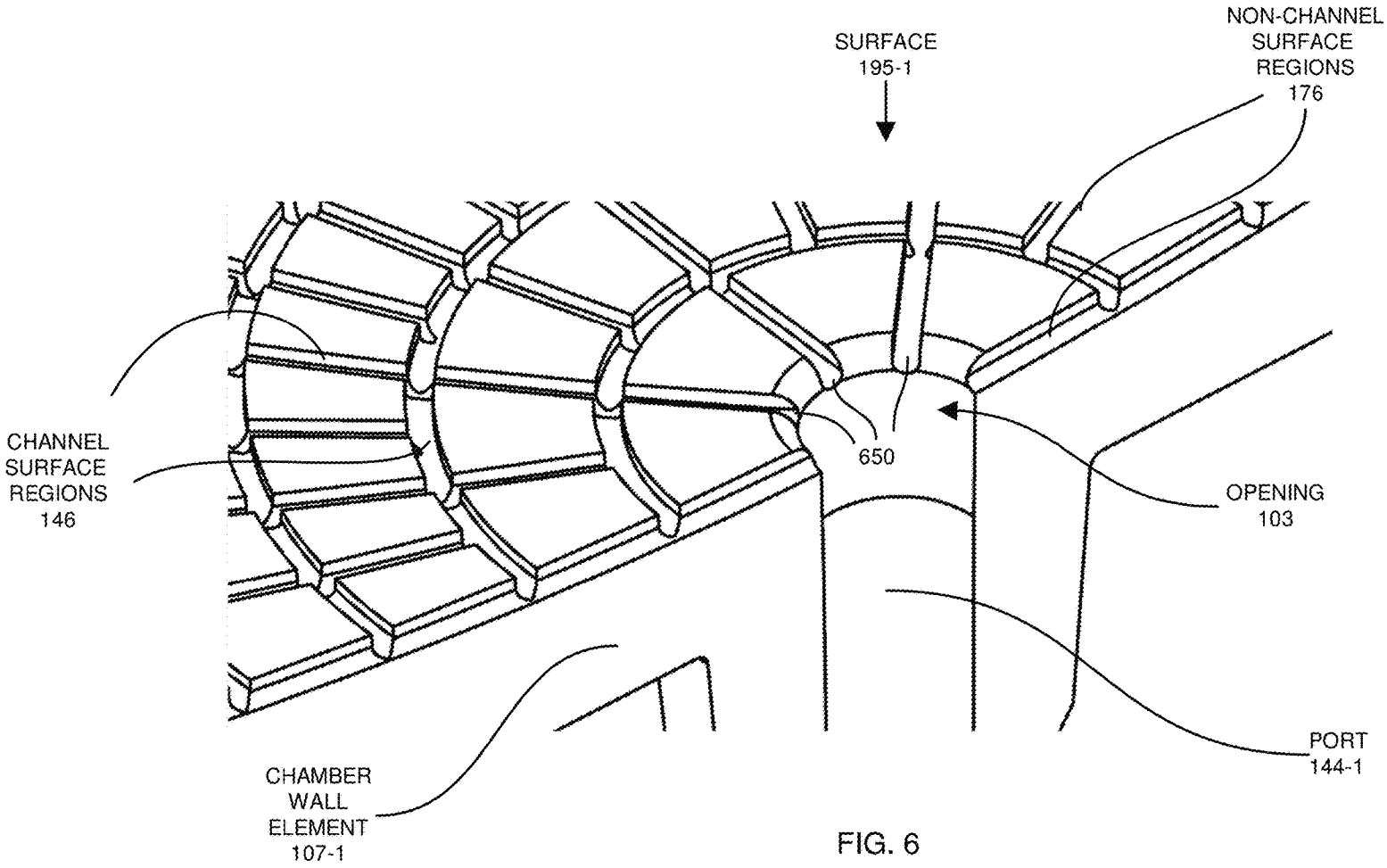
FIG. 6 is an example diagram illustrating a more detailed cutaway perspective view of a chamber wall surface of a diaphragm pump according to embodiments herein.

FIG. 6 is an example diagram illustrating a yet more detailed cutaway perspective view of a chamber wall surface of a diaphragm pump according to embodiments herein. This figure further illustrates how terminal ends 650 of the channel surface regions 146 near opening 103 are unobstructed even when the respective facing of the flexible membrane 127 is in contact with the non-channel surface regions 176.

Figure 7:
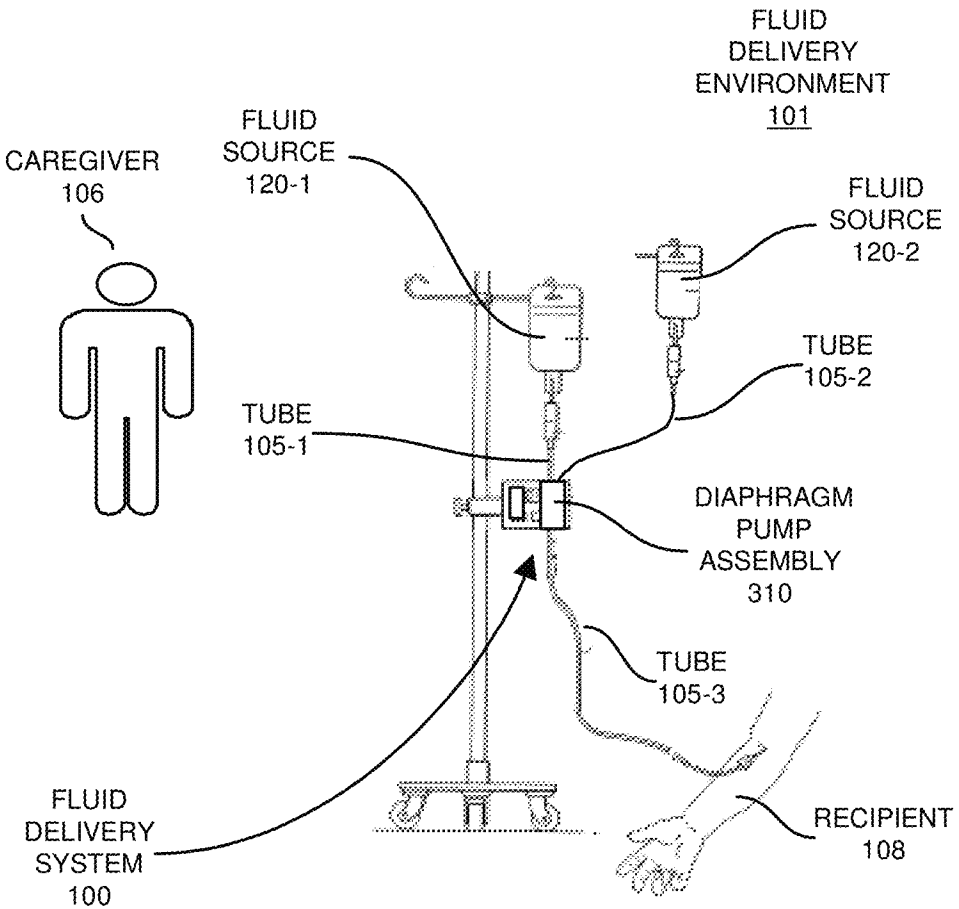
FIG. 7 is an example diagram illustrating a fluid delivery system including a diaphragm pump according to embodiments herein

FIG. 7 is an example diagram illustrating a fluid delivery system including a diaphragm pump according to embodiments herein.

As shown in this example embodiment, the fluid delivery environment 101 includes fluid delivery system 100. Fluid delivery system 100 (such as operated by caregiver 106) includes fluid source 120-1, fluid source 120-2, and recipient 108 (any type of target entity such as a human, machine, container, etc.).

Fluid delivery system 100 includes a diaphragm pump assembly 310, facilitating delivery of fluid from one or more fluid sources 120 to the recipient 108.

In one embodiment, a controller in the fluid delivery system 100 controls the diaphragm pump assembly 310 (such as disposed in a respective disposable cassette or cartridge) to deliver fluid from one or more fluid sources 120 (such as fluid source 120-1 and/or fluid source 120-2) through tube 105-3 to recipient 108. As shown in this example embodiment, tube 105-1 conveys fluid from fluid source 120-1 to diaphragm pump assembly 310. Tube 105-2 conveys fluid from fluid source 120-2 to diaphragm pump assembly 310.

Note that fluid source 120-1 and fluid source 120-2 can store the same or different fluids.

FIGS. 8-11 are example diagrams illustrating cutaway side views of a diaphragm pump during different stages of a pump cycle according to embodiments herein.

Figure 8:
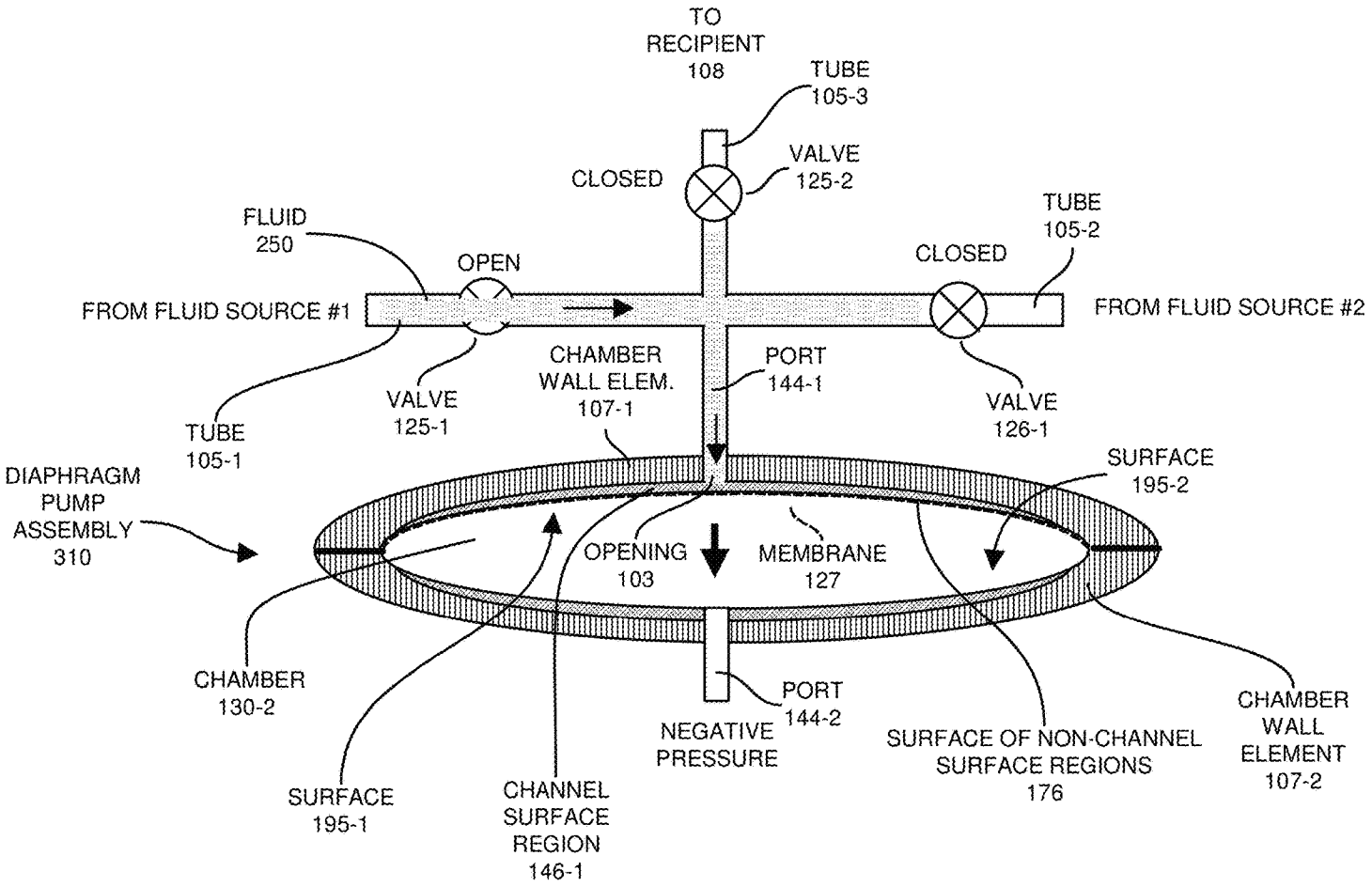
FIGS. 8-11 are example diagrams illustrating cutaway side views of a diaphragm pump during different stages of a pump cycle according to embodiments herein.

More particularly, FIG. 8 is an example diagram illustrating a cutaway side view of filling a chamber of a diaphragm pump assembly according to embodiments herein.

Figure 9:
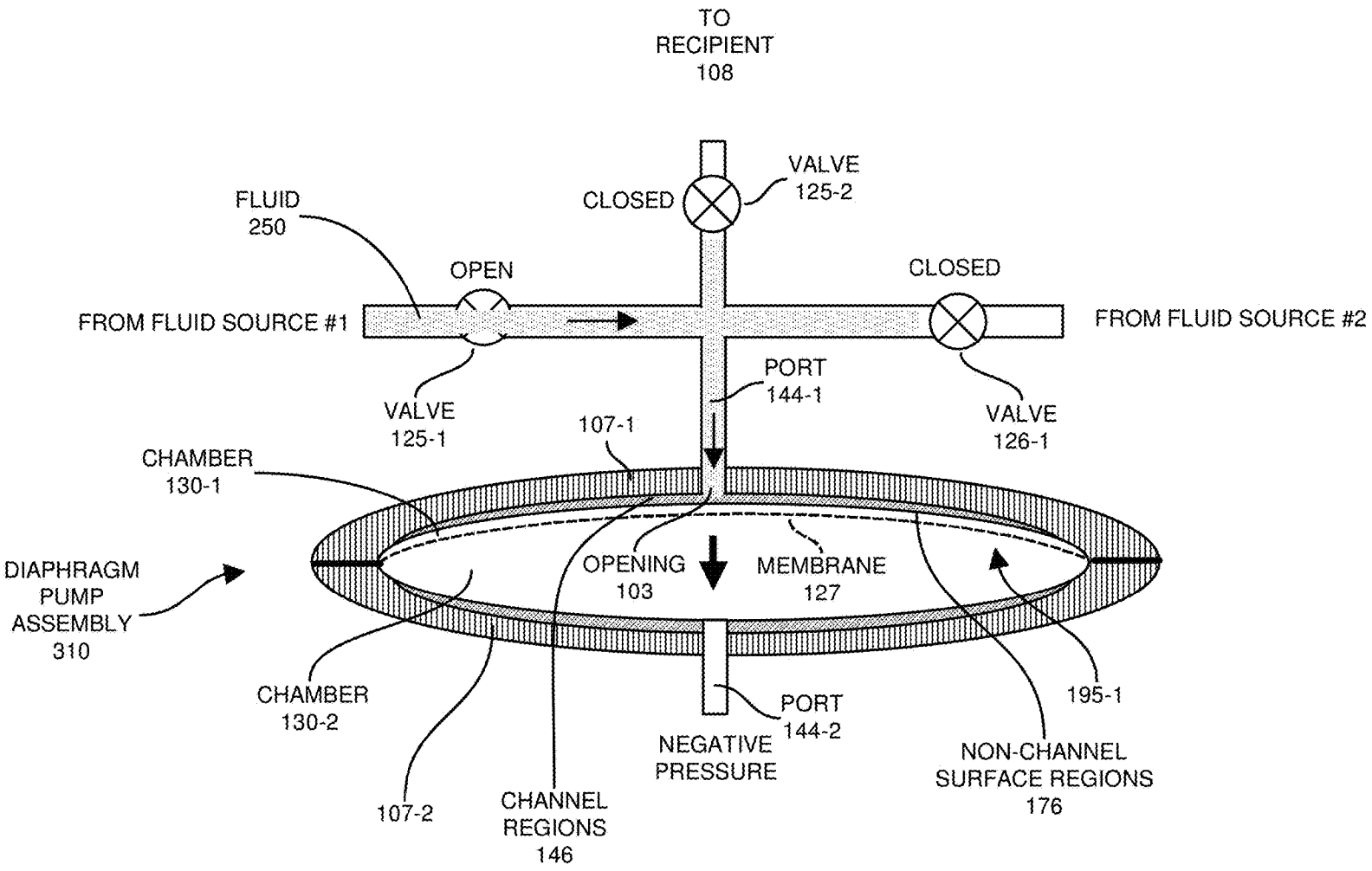

In this non-limiting example embodiment, to fill chamber 130-1, the controller resource associated with fluid delivery system 100 initiates opening the valve 125-1. The controller resource initiates closing of valve 125-2 and valve 126-1. The controller resource then applies a negative pressure to port 144-2. The negative pressure causes a respective facing of the flexible membrane 127 to pull away from surface 195-1. This causes a flow of fluid 250 from fluid source 120-1 through port 144-1 and opening 103, filling chamber 130-1 as shown in FIG. 9.

Initial flow of the fluid 250 through the channel surface regions 146 during application of the negative pressure airport 144-2 enables the flexible membrane 127 to pull away from non-channel surface regions 176 disposed on surface 195-1. Recall again that the non-channel surface regions 176 prevented the membrane 127 from occupying channel surface regions 146 on surface 195-1 of the chamber wall element 107-1.

In one embodiment, the controller resource of the fluid delivery system 100 applies a negative pressure to port 144-2 for a sufficient amount of time such that a respective facing of the flexible membrane 127 comes in contact with surface 195-2 on chamber wall element 107-2. This causes the chamber 130-1 to be completely filled with fluid 250.

Figure 10:
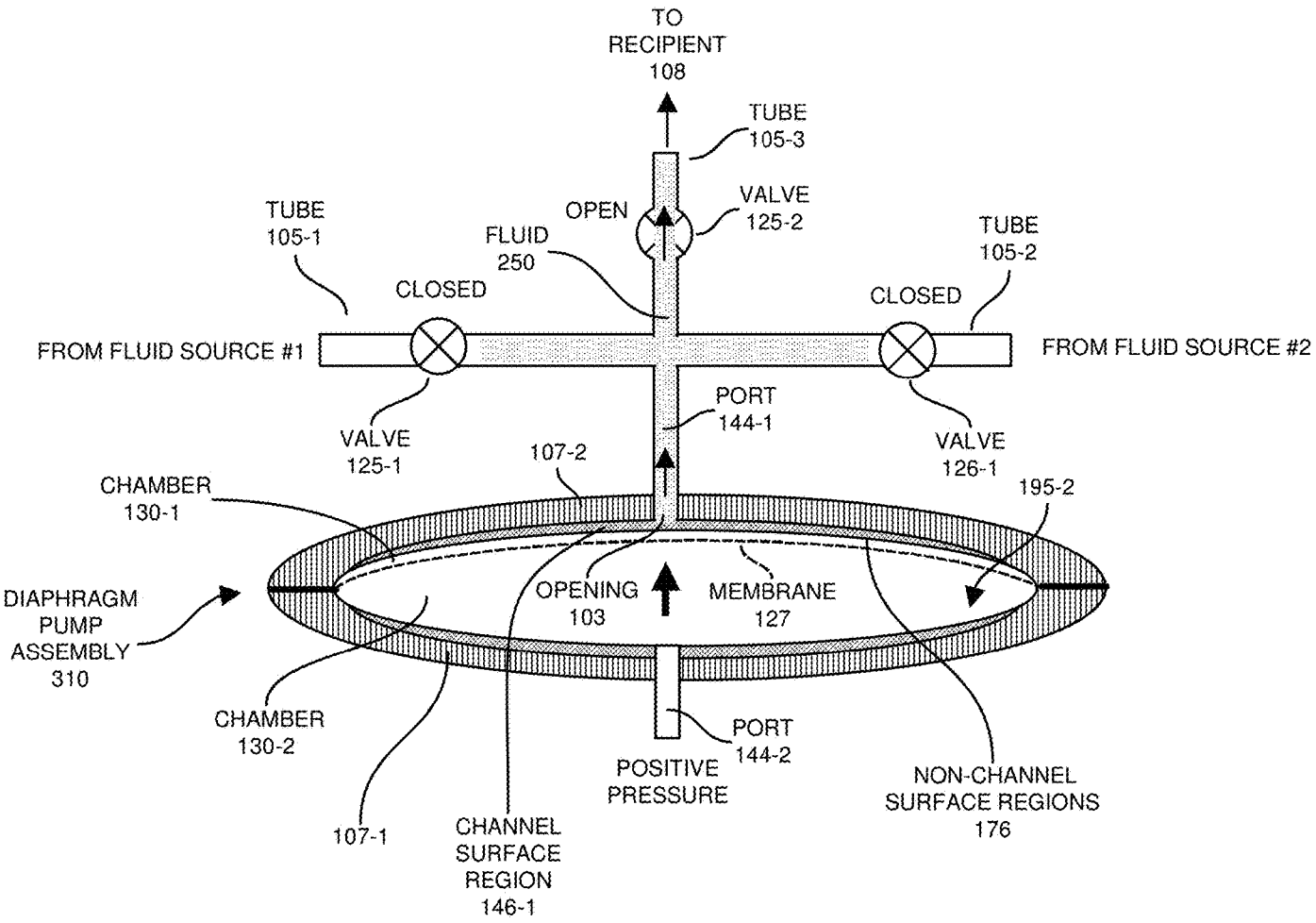

FIG. 10 is an example diagram illustrating a cutaway side view of filling a chamber in a diaphragm pump assembly and delivery of fluid according to embodiments herein.

In this non-limiting example embodiment, after filling chamber 130-1, the controller resource associated with fluid delivery system 100 initiates closing of the valve 125-1 and valve 126-1. The controller resource opens valve 125-2. The controller resource then applies a positive pressure to port 144-2. This causes the flexible membrane 127 to pull away from surface 195-2, decreasing a volume of chamber 130-1. As previously discussed, the channel regions disposed on chamber wall element 107-2 enable the flexible membrane 127 to easily push away from surface 195-2.

Figure 11:
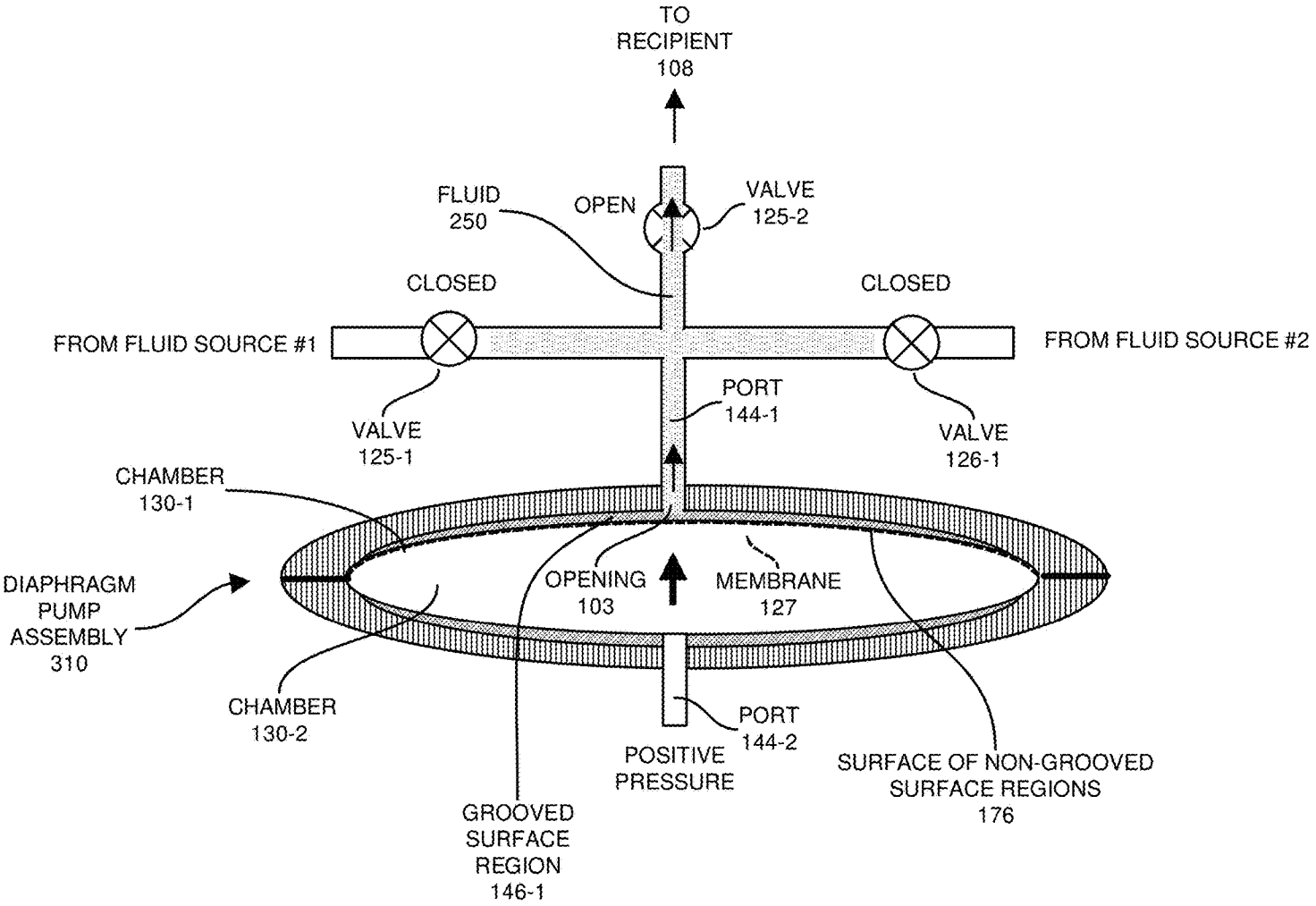

The application of positive pressure to port 144-2 causes a flow of fluid 250 from chamber 130-1 through a combination of opening 103, port 144-1, valve 125-2, and tube 105-3 to recipient 108. Eventually, application of the positive pressure to port 144-2 and corresponding chamber 130-2 causes a respective facing of the flexible membrane 127 to contact surface 195-1 as shown in FIG. 11. Recall again that the non-channel surface regions 176 prevent the membrane 127 from occupying channel surface regions 146, facilitating an unobstructed flow fluid 250 in chamber 130-1 to opening 103. Thus, the fluid 250 in chamber 130-1 is not needlessly trapped between the flexible membrane 127 and a corresponding flat surface as in the prior art.

Subsequent to completing a stroke of delivering the fluid 250 in the chamber 130-1, the controller resource of the fluid delivery system 100 opens valve 125-1 and closes valve 125-2 and valve 126-1 has previously discussed in FIG. 8. The controller resource then applies a negative pressure again to port 144-2. This causes the respective surface of the flexible membrane 127 to pull away from the surface 195-1. As previously discussed, presence of the channel surface regions 146 on the surface 195-1 enables the flexible membrane 127 to be easily pulled away from the non-channel surface regions 176 of surface 195-1.

Figure 12:
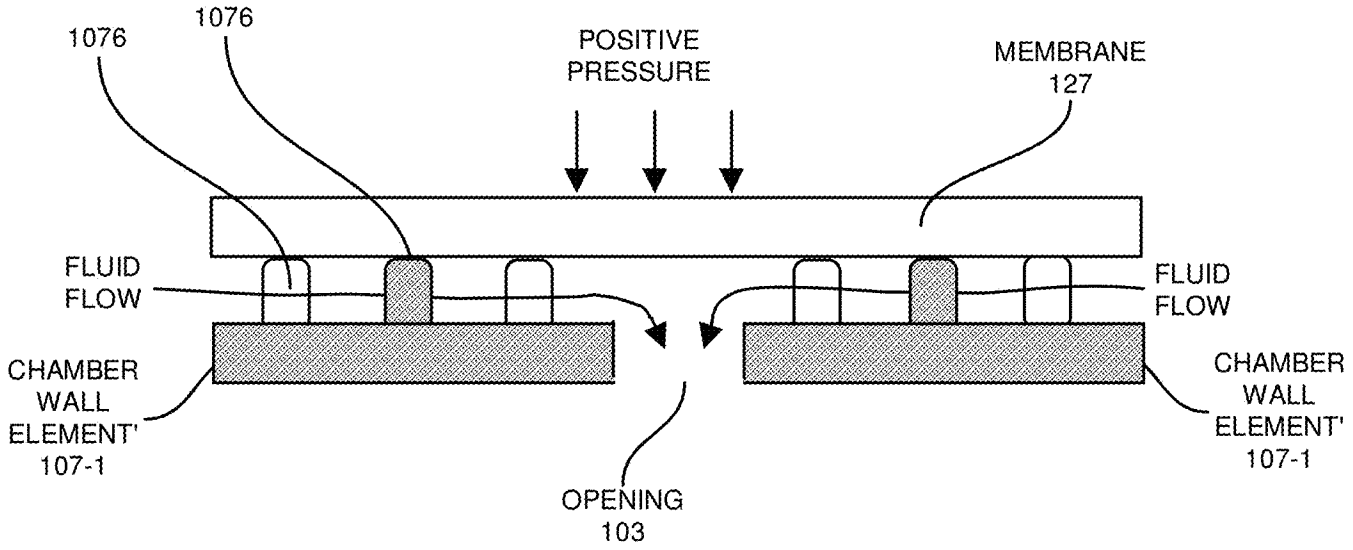
FIG. 12 is an example diagram illustrating a cross-sectional side view of a diaphragm pump according to embodiments herein.

FIG. 12 is an example diagram illustrating a cutaway side view of an example internal chamber wall surface of a diaphragm pump according to embodiments herein.

As shown, instead of including grooved channels, a respective surface in a chamber of the diaphragm pump 310 can include non-channel surface regions 1076 defining channel surface regions 1046. The channel surface regions 1046 provide an unobstructed pathway between flexible membrane 127 and the respective chamber wall element 107-1 to opening 103 and port 144-1.

Note that the channel surface regions 1046 amongst the non-channel surface regions 1076 can be of any suitable shape. For example, non-channel surface regions 1076 can be any suitable type of protrusions (spacers) such as cylindrical protrusions, conical protrusions, rounded protrusions, etc., disposed on chamber wall elements 107.

In a similar manner as previously discussed, note again that the non-channel surface regions 1076 can be disposed on a respective one or more surfaces of the flexible membrane 127.

Figure 13:
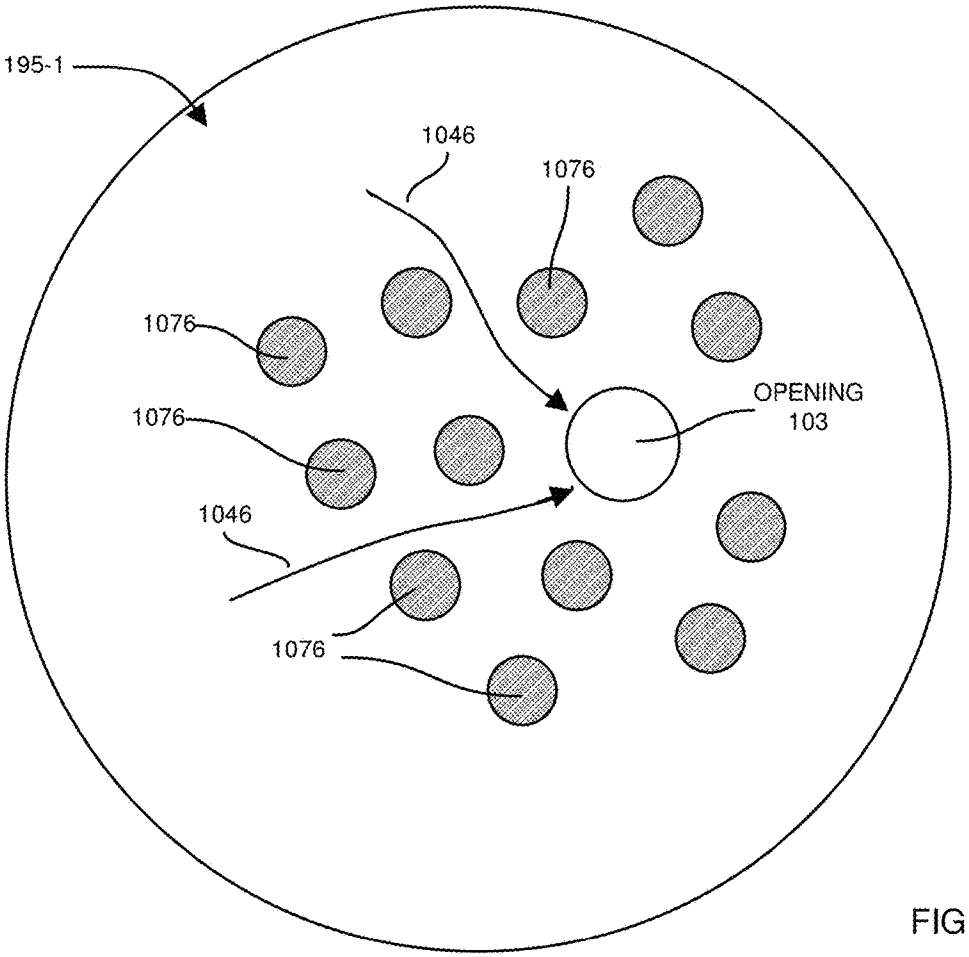
FIG. 13 is example diagram illustrating a top view of a diaphragm pump surface according to embodiments herein.

FIG. 13 is an example diagram illustrating a top view of an example of internal chamber wall surface of a diaphragm pump according to embodiments herein.

As shown, the non-channel surface regions 1076 disposed on the channel wall element 107-1 define channel surface regions 1046 facilitating an unobstructed pathway to opening 103, especially when the respective facing of membrane 127 is in contact with the surfaces of channel surface regions 1046 as shown in FIG. 12. In other words, in this non-limiting embodiment, non-channel surface regions 1076 are spacers preventing the membrane 127 from cutting off flow of fluid 250 to opening 103.

Functionality supported by the different resources will now be discussed via the flowchart in FIGS. 14 and 15. Note that the steps in the flowcharts below can be executed in any suitable order.

Figure 14:
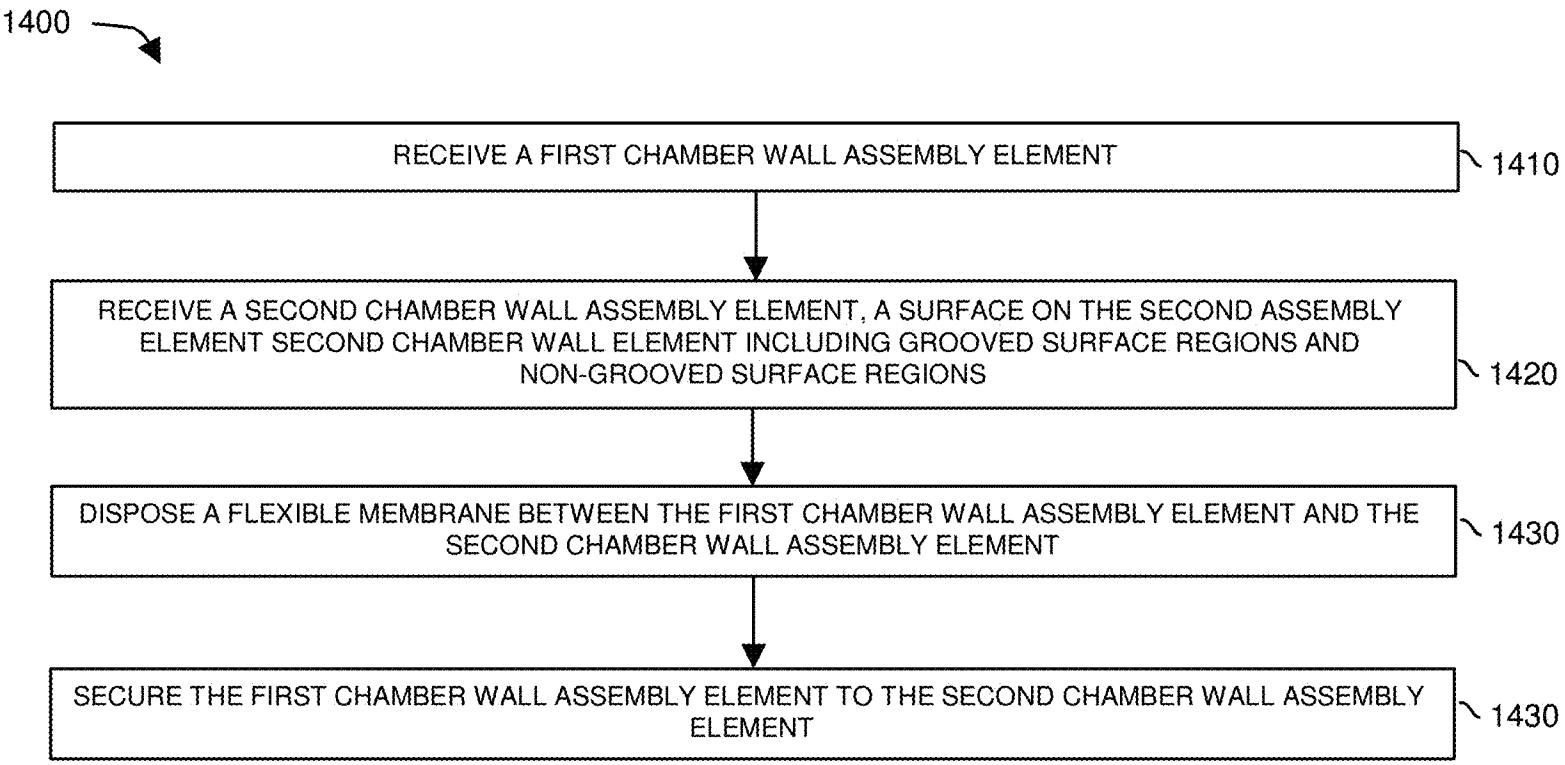
FIG. 14 is an example diagram illustrating a method of assembling a diaphragm pump according to embodiments herein.

FIG. 14 is a flowchart 1400 illustrating an example method according to embodiments. Note that there may be some overlap with respect to concepts as discussed above.

In processing block 1410, an assembly resource (human, machine, etc.) receives first chamber wall element 107-1.

In processing block 1420, the assembly resource receives second chamber wall element 107-2. As previously discussed, a surface on the first chamber wall element 107-1 includes channel surface regions 146 and non-channel surface regions 176. The surface and the second chamber wall element 107-2 can include channel surface regions 246 and non-channel surface regions 276.

In processing block 1430, the assembly resource disposes a flexible membrane 127 between the first chamber wall element 107-1 and the second chamber wall element 107-2.

In processing block 1440, the assembly resource secures (such as via glue, screws, clamps, etc.) the first chamber wall element 107-1 to the second chamber wall element 107-2. Sandwiched in between the first chamber wall element 107-1 and the second chamber wall element 107-2 is the flexible membrane in 127. As previously discussed, each of the chamber wall elements includes at least one opening as well as one or more channel surface regions extending to the openings.

Figure 15:
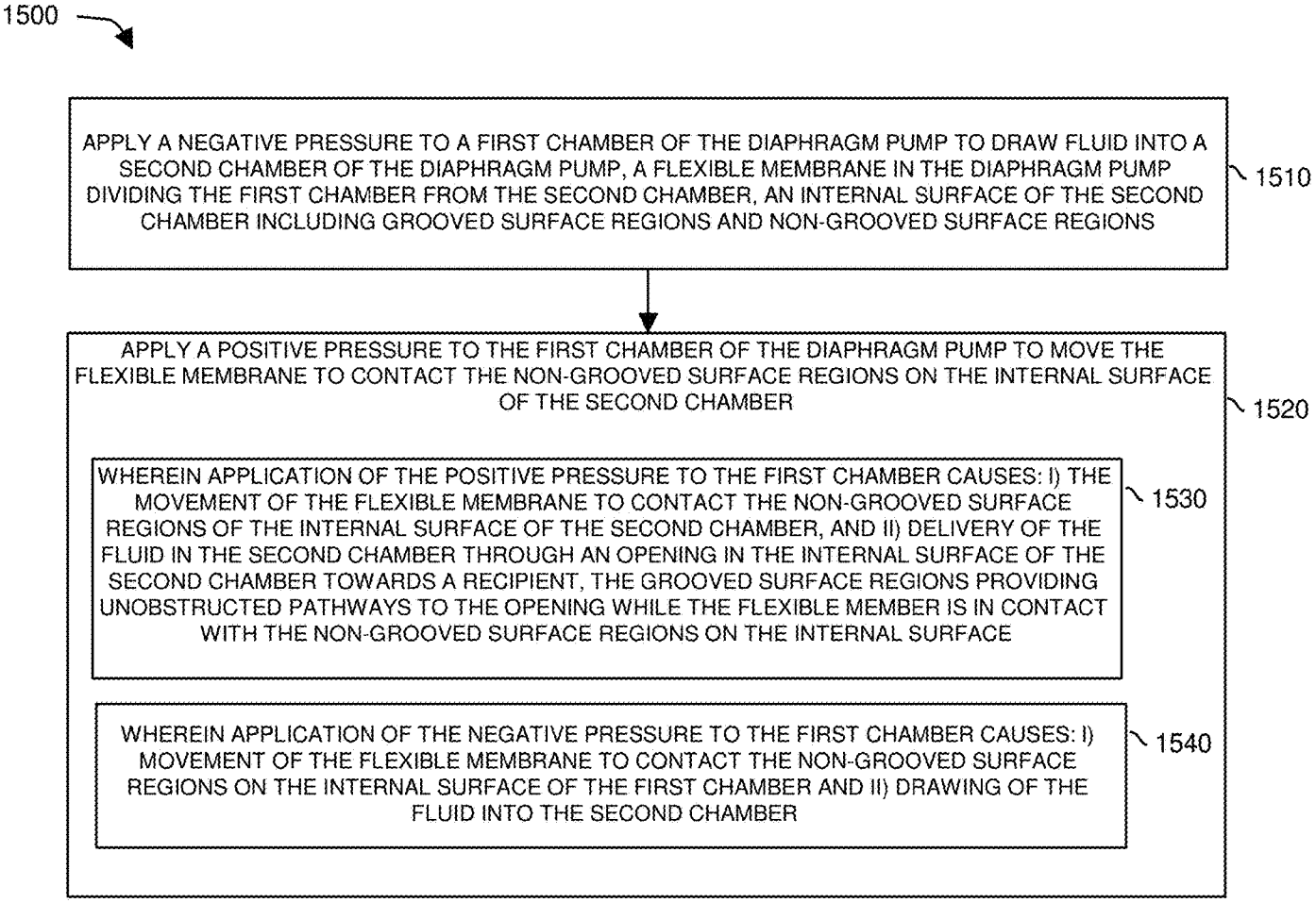
FIG. 15 is an example diagram illustrating a method of operating a diaphragm pump according to embodiments herein.

FIG. 15 is a flowchart 1500 illustrating an example method according to embodiments. Note that there will be some overlap with respect to concepts as discussed above.

In processing block 1510, a controller in fluid delivery system 100 applies a negative pressure to chamber 130-2 of the diaphragm pump assembly 310 to draw fluid into a chamber 130-1 of the diaphragm pump assembly 310. As previously discussed, a flexible membrane 127 in the diaphragm pump assembly 310 separates (device) the chamber 130-1 from the chamber 130-2. An internal surface 195-1 of the chamber 130-1 includes channel surface regions 146 and non-channel surface regions 146.

In processing block 1520, the controller in the fluid delivery system 100 applies a positive pressure to the chamber 130-2 of the diaphragm pump assembly 310 to move the flexible membrane 127 to contact the non-channel surface regions 176 on the internal surface 195-1 of the chamber 130-1.

In one embodiment, as previously discussed, application of the positive pressure to the chamber 130-2 causes: i) the movement of the flexible membrane 127 to contact the non-channel surface regions 176 of the internal surface of the chamber 130-1, and ii) delivery of the fluid 250 in the chamber 130-1 through an opening 103 in the internal surface of the chamber 130-1 through tube 105-3 towards recipient 108. The channel surface regions 146 provide unobstructed pathways to the opening 103 while a facing of the flexible membrane 127 is substantially in contact with the non-channel surface regions 176 on the internal surface of chamber 130-1.

In yet further embodiments, subsequent to completing a pump stroke, application of the negative pressure to the chamber 130-1 by the controller of the fluid delivery system 100 further causes: i) movement of the flexible membrane 127 away from non-channel surface regions 176 and contact of the opposite facing of the flexible membrane 127 to non-channel surface regions 276 on the internal surface of the chamber 130-2 and ii) drawing of the fluid into the chamber 130-1.

This process is repeated any number of times to deliver fluid to the respective recipient 108 and a desired rate. Of course, the time between repeated cycles of filling chamber 103-1 and expelling such fluid through opening 103 to the recipient 108 dictates a respective flow rate.

Figure 16:
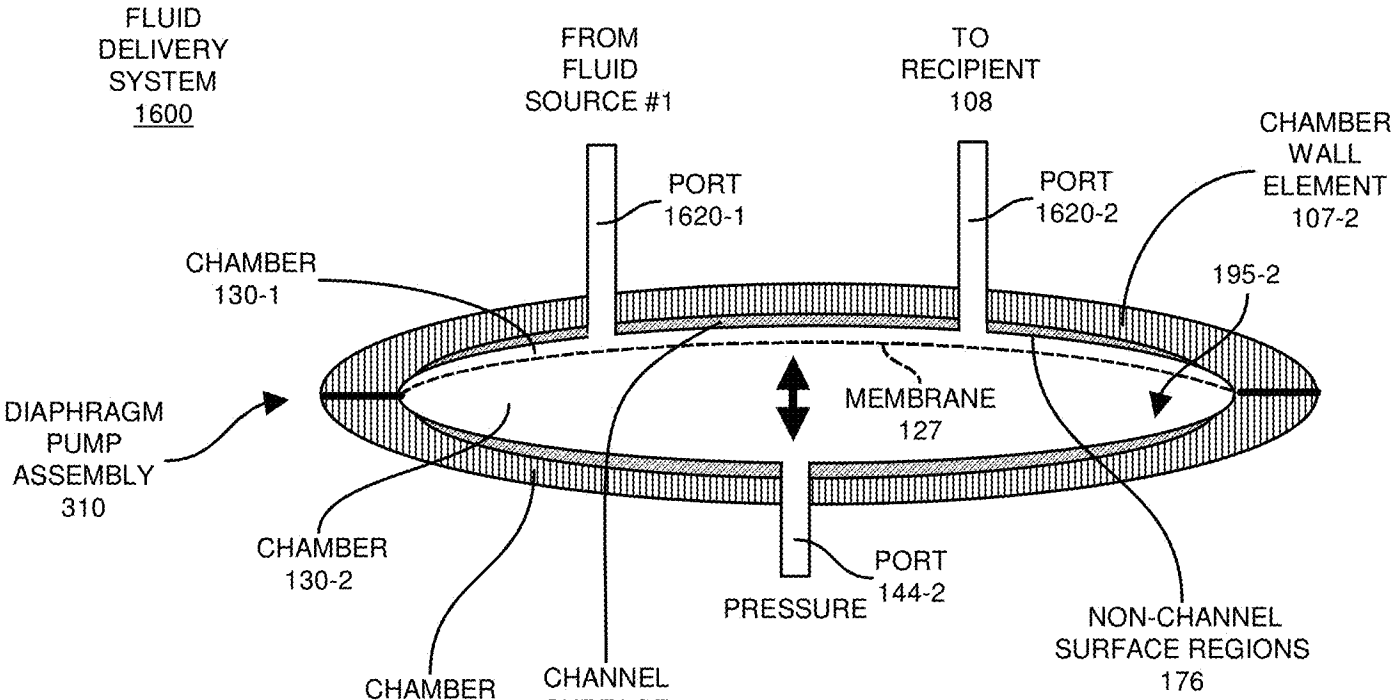
FIG. 16 is an example diagram illustrating a cutaway side view of a diaphragm pump according to embodiments herein.

FIG. 16 is an example diagram illustrating a cutaway side view of a diaphragm pump according to embodiments herein.

Note that fluid delivery system 1600 includes any suitable number of valves, tubes, etc., in communication with the respective ports of diaphragm pump assembly 310 to facilitate delivery of fluid as further discussed below.

As shown in this example embodiment, the diaphragm pump assembly 310 includes chamber wall element 107-1 and chamber wall element 107-2. In this non-limiting example embodiment, chamber wall element 107-1 includes port 144-2 to receive (at different times of a delivery cycle) positive and negative pressure as previously discussed. More specifically, application of negative pressure to port 144-2 and corresponding membrane 127 in this example causes fluid to be drawn from port 1620-1 (from any of one or more sources) into chamber 130-1. Conversely, subsequent to filling chamber 130-1, application of positive pressure to port 144-2 and corresponding membrane 127 causes fluid in chamber 130-1 to be delivered through port 1620-2 to recipient 108.

Accordingly, if desired, the chamber wall element 107-2 can include any suitable number of ports.

Figure 17:
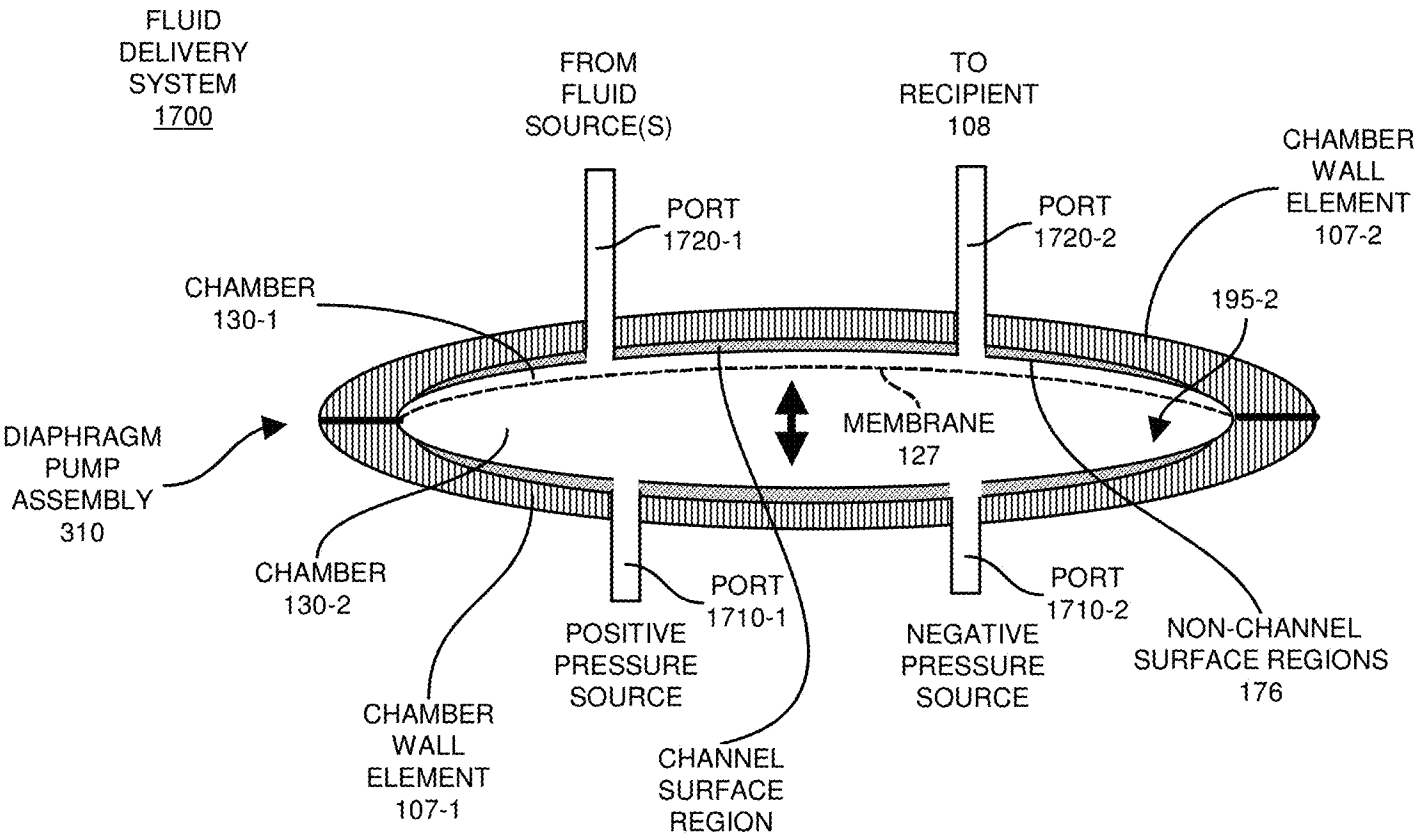
FIG. 17 is an example diagram illustrating a cutaway side view of a diaphragm pump according to embodiments herein.

FIG. 17 is an example diagram illustrating a cutaway side view of a diaphragm pump according to embodiments herein.

Note that fluid delivery system 1700 includes any suitable number of valves, tubes, etc., in communication with the respective ports of diaphragm pump assembly 310 to facilitate delivery of fluid as further discussed below.

As shown in this example embodiment, the diaphragm pump assembly 310 includes chamber wall element 107-1 and chamber wall element 107-2. In this non-limiting example embodiment, chamber wall element 107-1 includes port 1710-1 to receive positive pressure from a respective source. Chamber wall element 107-1 also includes port 1710-2 to receive negative pressure from a respective pressure source. In a similar manner as previously discussed, application of negative pressure to port 1710-2 and corresponding membrane 127 causes fluid to be drawn from port 1720-1 into chamber 130-1. Conversely, application of positive pressure to port 1710-1 and corresponding membrane 127 causes fluid in chamber 130-1 to be delivered through port 1720-2 to recipient 108.

Figure 18:
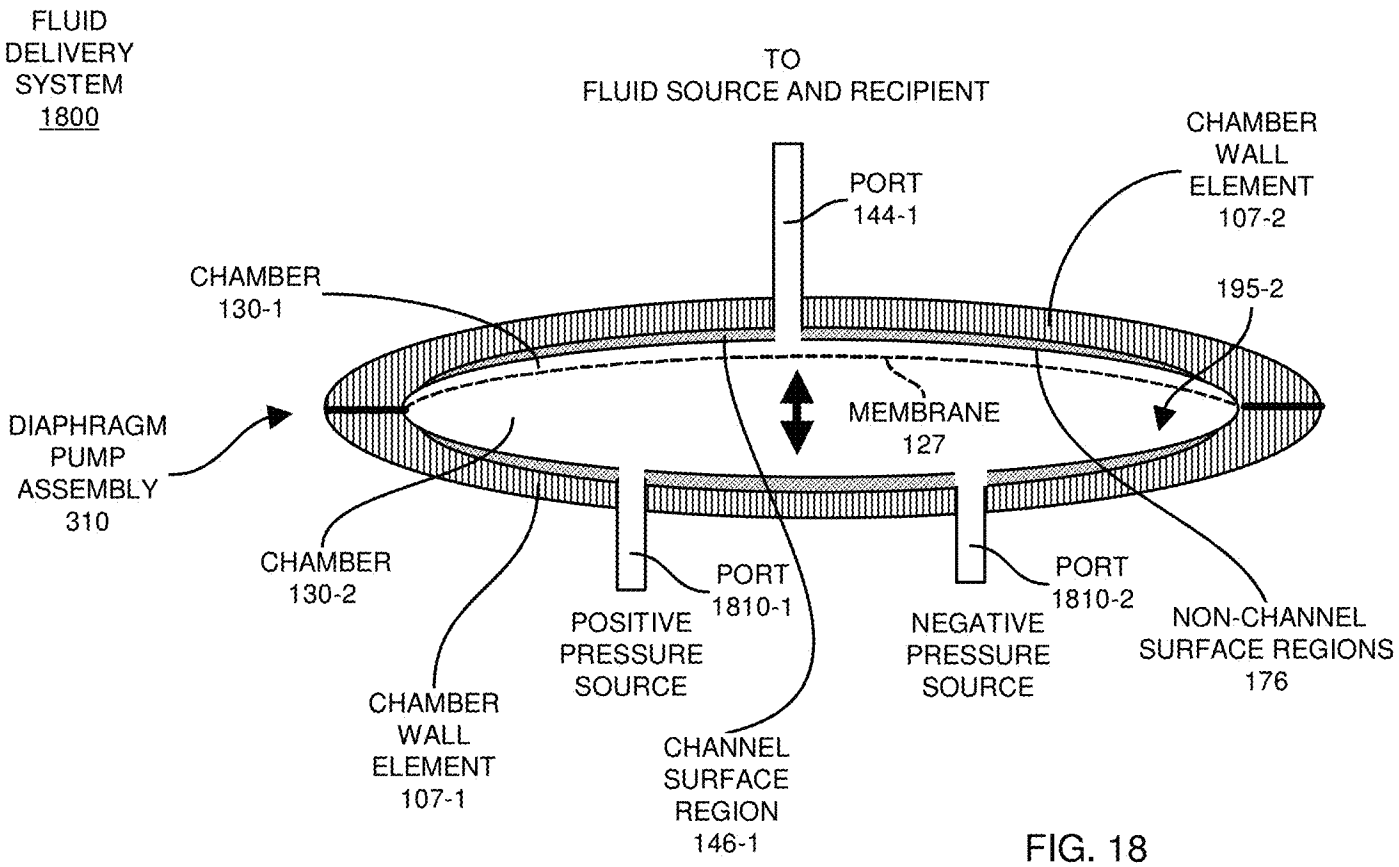
FIG. 18 is is an example diagram illustrating a cutaway side view of a diaphragm pump according to embodiments herein.

FIG. 18 is an example diagram illustrating a cutaway side view of a diaphragm pump according to embodiments herein.

Note that fluid delivery system 1800 includes any suitable number of valves, tubes, etc., in communication with the respective ports of diaphragm pump assembly 310 to facilitate delivery of fluid as further discussed below.

As shown in this example embodiment, the diaphragm pump assembly 310 includes chamber wall element 107-1 and chamber wall element 107-2. In this non-limiting example embodiment, chamber wall element 107-1 includes port 1810-1 to receive positive pressure from a respective source. Chamber wall element 107-1 also includes port 1810-2 to receive negative pressure from a respective pressure source.

In a similar manner as previously discussed, application of negative pressure to port 1810-2 and corresponding membrane 127 causes fluid to be drawn from port 144-1 into chamber 130-1. Conversely, subsequent application of positive pressure to port 1810-1 and corresponding membrane 127 causes fluid in chamber 130-1 to be delivered through port 144-1.

Note again that techniques herein are well suited for use in any suitable type of fluid delivery systems and diaphragm pumps. However, it should be noted that embodiments herein are not limited to use in such applications and that the techniques discussed herein are well suited for other applications as well.

Based on the description set forth herein, numerous specific details have been set forth to provide a thorough understanding of claimed subject matter. However, it will be understood by those skilled in the art that claimed subject matter may be practiced without these specific details. In other instances, methods, apparatuses, systems, etc., that would be known by one of ordinary skill have not been described in detail so as not to obscure claimed subject matter. Some portions of the detailed description have been presented in terms of algorithms or symbolic representations of operations on data bits or binary digital signals stored within a computing system memory, such as a computer memory. These algorithmic descriptions or representations are examples of techniques used by those of ordinary skill in the data processing arts to convey the substance of their work to others skilled in the art. An algorithm as described herein, and generally, is considered to be a self-consistent sequence of operations or similar processing leading to a desired result. In this context, operations or processing involve physical manipulation of physical quantities. Typically, although not necessarily, such quantities may take the form of electrical or magnetic signals capable of being stored, transferred, combined, compared or otherwise manipulated. It has been convenient at times, principally for reasons of common usage, to refer to such signals as bits, data, values, elements, symbols, characters, terms, numbers, numerals or the like. It should be understood, however, that all of these and similar terms are to be associated with appropriate physical quantities and are merely convenient labels. Unless specifically stated otherwise, as apparent from the following discussion, it is appreciated that throughout this specification discussions utilizing terms such as "processing," "computing," "calculating," "determining" or the like refer to actions or processes of a computing platform, such as a computer or a similar electronic computing device, that manipulates or transforms data represented as physical electronic or magnetic quantities within memories, registers, or other information storage devices, transmission devices, or display devices of the computing platform.

While this invention has been particularly shown and described with references to preferred embodiments thereof, it will be understood by those skilled in the art that various changes in form and details may be made therein without departing from the spirit and scope of the present application as defined by the appended claims. Such variations are intended to be covered by the scope of this present application. As such, the foregoing description of embodiments of the present application is not intended to be limiting. Rather, any limitations to the invention are presented in the following claims.

We claim:

1. An apparatus comprising:

a flexible membrane;

a chamber wall including a surface, the surface including channel surface regions and non-channel surface regions, the channel surface regions including a first set of channel surface regions and a second set of channel surface regions;

a combination of the chamber wall and the flexible membrane defining a pump chamber; and an opening disposed in the chamber wall and extending through the surface to the pump chamber, each of the channel surface regions in the first set terminating at the opening and being intersected by a first channel surface region in the second set;

wherein the opening is a first opening, the apparatus further comprising:

a second opening disposed in the chamber wall extending through the surface to the pump chamber; and a portion of the channel surface regions in the chamber wall defining channel pathways extending from the first opening to the second opening.

2. The apparatus as in claim 1, wherein the surface on the chamber wall is concave.

3. The apparatus as in claim 1, wherein the non-channel surface regions are planar in comparison to the channel surface regions.

4. The apparatus as in claim 1, wherein the flexible membrane includes a first facing disposed opposite a second facing, the first facing of the flexible membrane and the surface of the chamber wall defining the pump chamber; and wherein application of pressure against the second facing of the flexible membrane forces the first facing of the flexible membrane to contact the non-channel surface regions of the surface on the chamber wall.

5. The apparatus as in claim 1, wherein the first set of channel surface regions and the flexible membrane provide an unobstructed pathway to the first opening while the facing of the flexible membrane is in contact with the non-channel surface regions on the surface of the chamber wall.

6. The apparatus as in claim 1, wherein the surface of the chamber wall is concave, the first opening being disposed at a center of the concave surface.

7. The apparatus as in claim 1, wherein the first set of channel surface regions define first channels that extend radially outward from the first opening.

8. The apparatus as in claim 1, wherein a portion of the channel surface regions extend from the first opening to a location in which the flexible membrane contacts the surface of the chamber wall.

9. The apparatus as in claim 1, wherein a depth of each of the channel surface regions is substantially similar.

10. The apparatus as in claim 1, wherein the channel surface regions are grooved surface regions; and wherein the non-channel surface regions are non-grooved surface regions.

11. The apparatus as in claim 1, wherein each of the channel surface regions in the first set is intersected by a second channel surface region in the second set.

12. The apparatus as in claim 1, wherein the chamber wall is a first chamber wall of a respective diaphragm pump, the apparatus further comprising:

a second chamber wall, the flexible membrane disposed between the first chamber wall and the second chamber wall.

13. The apparatus as in claim 12, wherein the second chamber wall includes channel surface regions and non-channel surface regions.

14. The apparatus as in claim 1, wherein the first set of channel surface regions includes a first channel terminating at the first opening and a second channel terminating at the first opening, the first channel and the second channel interconnected by the first channel surface region in the second set, the first channel surface region of the second set defined by a set of the non-channel surface regions on the surface of the chamber wall.

15. The apparatus as in claim 14, wherein portions of the non-channel surface regions define a portion of the first opening in the chamber wall.

16. The apparatus as in claim 1, wherein a set of the non-channel surface regions are disposed concentrically about the first opening.

17. The apparatus as in claim 16, wherein a respective edge of each of the non-channel surface regions in the set of non-channel surface regions define a sidewall of the first opening into the chamber.

18. The apparatus as in claim 1, wherein the second set of channel surface regions define non-intersecting concentric channels with respect to the first opening in the chamber wall.

19. The apparatus as in claim 18, wherein the first set of channel surface regions define first channels that extend radially outward from the first opening; and wherein each of the channel surface regions in the first set intersects with each of the non-intersecting concentric channels in the second set.

20. The apparatus as in claim 1, wherein the first channel surface region in the second set is a first circular-shaped channel disposed in the chamber wall.

21. The apparatus as in claim 20, wherein a second channel surface region in the second set is a circular-shaped channel disposed in the chamber wall, each of the channel surface regions in the first set being intersected by the second channel surface region in the second set.

* * * * *